US007950118B1

(12) United States Patent
Fumo

(10) Patent No.: US 7,950,118 B1
(45) Date of Patent: May 31, 2011

(54) MEMORIAL URN ASSEMBLY

(76) Inventor: Pamela M. Fumo, St. Louis, MO (US)

( * ) Notice: Subject to any disclaimer, the term of this patent is extended or adjusted under 35 U.S.C. 154(b) by 0 days.

(21) Appl. No.: 12/687,338

(22) Filed: Jan. 14, 2010

(51) Int. Cl.
*A61G 17/00* (2006.01)

(52) U.S. Cl. ..... 27/1

(58) Field of Classification Search ..... 27/1, 35; D99/5; 220/4.24, 23.2, 23.4, 501, 502, 524, 220/136, 137; 52/136
See application file for complete search history.

(56) References Cited

U.S. PATENT DOCUMENTS

| | | | | |
|---|---|---|---|---|
| 5,029,373 | A * | 7/1991 | Raymond | 27/1 |
| 5,815,897 | A * | 10/1998 | Longstreth | 27/1 |
| 5,832,575 | A | 11/1998 | Sturino | |
| 5,950,287 | A * | 9/1999 | Cacciatore et al. | 27/1 |
| D445,557 | S | 7/2001 | Chang | |
| 6,295,705 | B1 | 10/2001 | Gersten | |
| 6,665,916 | B1 | 12/2003 | Santorello et al. | |
| 6,944,921 | B1 | 9/2005 | Gersten | |
| 7,096,546 | B2 | 8/2006 | Poirier | |
| 7,110,570 | B1 | 9/2006 | Berenz et al. | |
| 7,191,499 | B2 | 3/2007 | Davis et al. | |
| 7,421,765 | B1 | 9/2008 | Kaiser | |
| 7,475,457 | B1 * | 1/2009 | Gersten | 27/1 |
| 2005/0120525 | A1 | 6/2005 | Heil et al. | |
| 2006/0207075 | A1 * | 9/2006 | Davis | 27/1 |
| 2010/0043187 | A1 * | 2/2010 | Steuer et al. | 27/1 |
| 2010/0212123 | A1 * | 8/2010 | Elhaj | 27/1 |
| 2010/0212355 | A1 * | 8/2010 | Elhaj | 63/1.14 |

* cited by examiner

*Primary Examiner* — William L. Miller

(57) ABSTRACT

A memorial urn assembly for comingling remains from two containers includes a pair of containers such that each of the containers includes a perimeter wall defining an interior. The perimeter wall has an interior surface and an exterior surface. The perimeter wall of one of the containers has a mating area configured to engage with a mating area of another one of the containers. The containers are couplable together so that the interior of one of the assemblies is in fluid communication with the interior of another one of the assemblies.

6 Claims, 3 Drawing Sheets

MEMORIAL URN ASSEMBLY

BACKGROUND OF THE DISCLOSURE

Field of the Disclosure

The disclosure relates to cremation vessels and more particularly pertains to a new cremation vessel for comingling remains from two containers.

SUMMARY OF THE DISCLOSURE

An embodiment of the disclosure meets the needs presented above by generally comprising a pair of containers such that each of the containers includes a perimeter wall defining an interior. The perimeter wall has an interior surface and an exterior surface. The perimeter wall of one of the containers has a mating area configured to engage with a mating area of another one of the containers. The containers are couplable together so that the interior of one of the assemblies is in fluid communication with the interior of another one of the assemblies.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
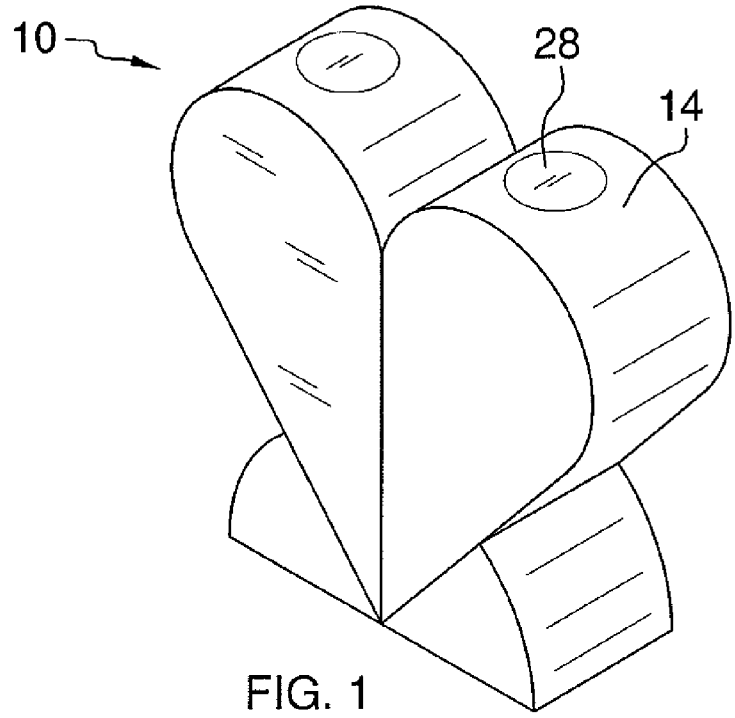
FIG. 1 is a front right view of a memorial urn assembly according to an embodiment of the disclosure.
Figure 2:
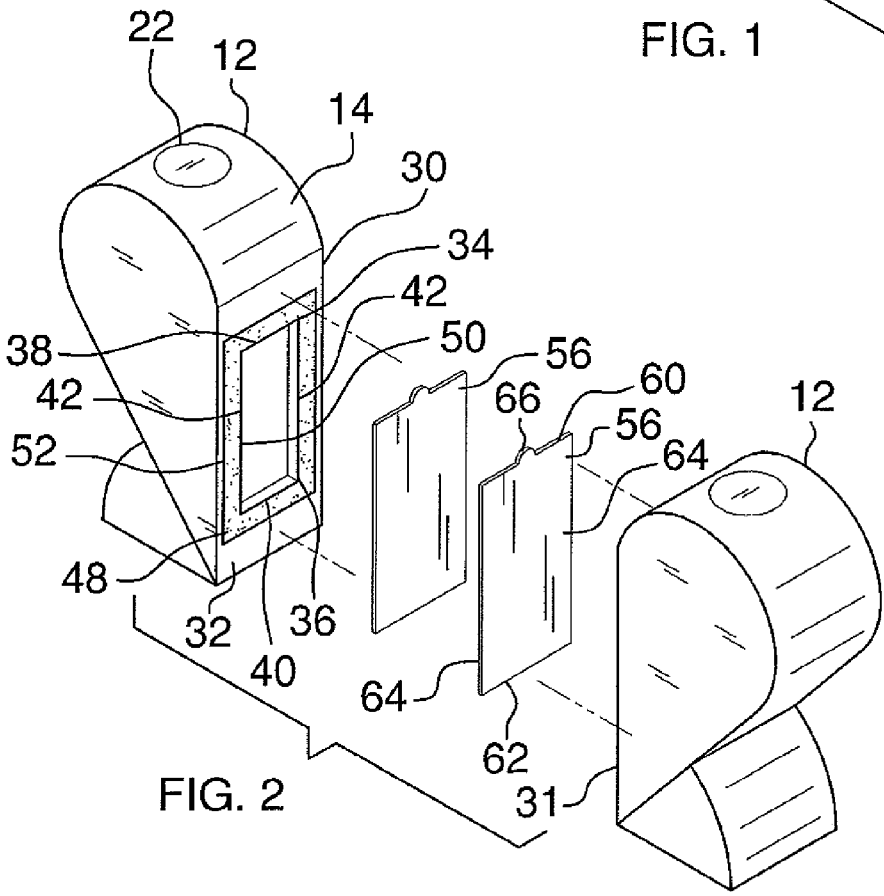
FIG. 2 is a front right exploded view of an embodiment of the disclosure.
Figure 3:
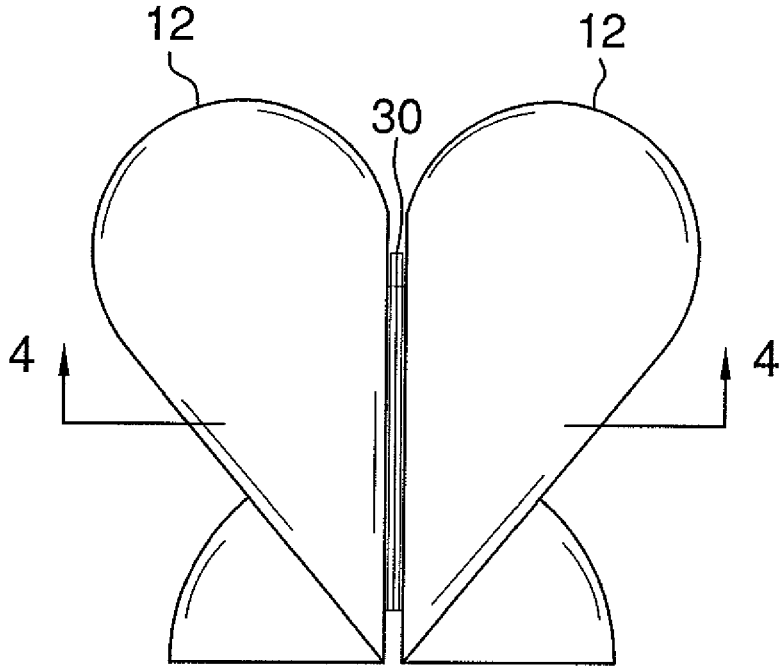
FIG. 3 is a front view of an embodiment of the disclosure.
Figure 4:
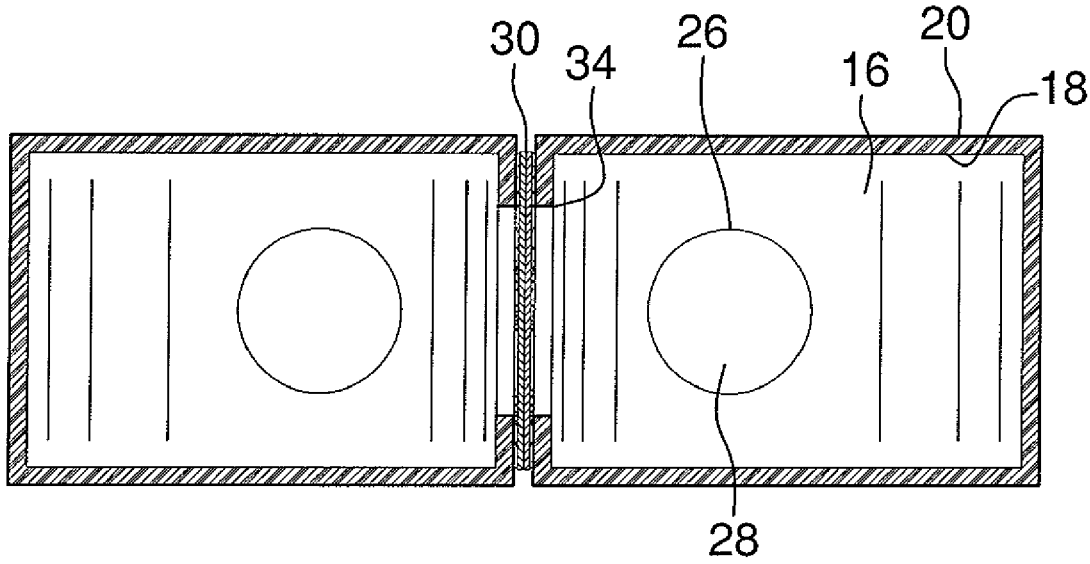
FIG. 4 is a cross-section view at line 4-4 of an embodiment of the disclosure.
Figure 5:
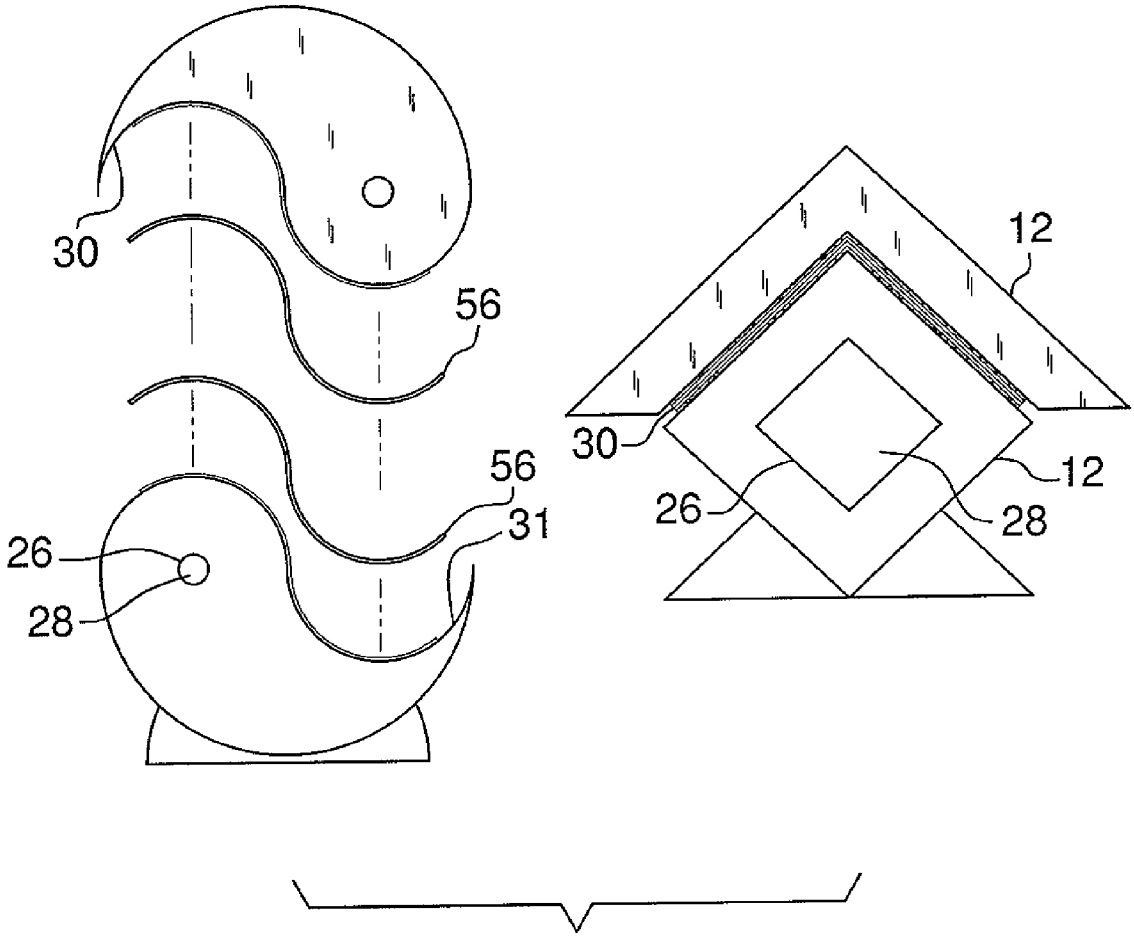
FIG. 5 is a front view of various embodiments of the disclosure.

With reference now to the drawings, and in particular to FIGS. 1 through 5 thereof, a new cremation vessel embodying the principles and concepts of an embodiment of the disclosure and generally designated by the reference numeral 10 will be described.

As best illustrated in FIGS. 1 through 5, the memorial urn assembly 10 generally comprises a pair of containers 12, 31 such that each of the containers 12, 31 includes a perimeter wall 14 that defines an interior 16. The perimeter walls 14 of the containers each have an interior surface 18, an exterior surface 20, and a filling aperture 22 therein for filling the associated container 12, 31 with particulate matter. The filling apertures 22 have a continuous outer edge 26 and extend through the exterior 20 and interior 18 surfaces. Although the filling apertures 22 are depicted as having a substantially circular shape, it is to be appreciated that the shape of the filling aperture 22 could be any suitable shape, including a square shape or an elongated shape. The containers 12, 31 each have a sealing plug 28 that is removably received by the filling apertures 22 for sealing the filling apertures 22.

The perimeter walls 14 of the containers 12, 31 each include a mating area 30 configured to engage with each other. The mating areas 30 include a mating surface 32 that having an opening 34 extending therethrough for granting access to the interior 16 of the containers 12, 31.

These openings 34 are defined by perimeter edges 36 that have a top edge 38, a bottom edge 40 and a pair of lateral side edges 42. A first width of the openings 34 is defined as a distance between the lateral side edges 42, while a first height is defined as a distance between the top edge 38 and the bottom edge 40. The first width may range from approximately 0.5 inches to 6 inches or from approximately 1 inch to 3 inches. The first height may range from approximately 2 inches to 12 inches or from approximately 3 inches to 5 inches.

The mating surfaces each include a continuous adhesive strip 48 positioned on the mating surfaces 32 and surrounding the perimeter edges. The adhesive strips 48 have an interior edge 50 adjacent the perimeter edge 36 and an exterior edge 52. The adhesive strips 48 have a second width defined as a distance between an interior edge 50 and an exterior edge 52 thereof. The second width may be from approximately 0.125 inches to 1.5 inches, or from approximately 0.25 inches 0.75 inches. Barriers 56 are removably attached to the adhesive strips 48 of the mating surfaces 32 for sealing the openings 34. It will be realized by one skilled in the art that the barriers 56 may be attached to the mating surfaces 32 using other suitable attachment means, such as, for example, heat or pressure welding. The barriers 56 include a flexible wall having a top end 60, a bottom end 62, and a pair of lateral side ends 64. The barriers 56 each have a tab 66 attached thereto to aid removal of the barriers 56 from the mating surfaces 32. The tabs 66 may extend beyond the second width of the adhesive strips 48. The barriers 56 have a third width defined as a distance between the lateral side ends 64 and a second height defined as a distance between the top end 60 and the bottom end 62. The third width of the barriers 56 may exceed the first width of the openings 34 and the second height of the barriers 56 may exceed the first height of the openings 34.

In use, the containers 12 are coupled together with barrier 56 in place so that the remains of one individual are sealed in one of the assemblies until the remains of a second individual are ready to be placed into another one of the assemblies. When both assemblies contain remains, the barrier 56 is removed so that openings 34 of the containers 12, 31 are aligned with each other and the interiors 16 of the containers 12, 31 are fluid communication with each to comingle the remains.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A memorial urn assembly configured for storing cremated remains, said assembly comprising:

a pair of containers, each of said container including;

a perimeter wall defining an interior, said perimeter wall having an interior surface and an exterior surface, said perimeter wall having a filling aperture therein for filling said interior with the cremated remains, said filling aperture having a continuous outer edge and extending through said exterior surface and said interior surface;

said perimeter wall of one of said containers having a mating area configured to engage with a mating area of another one of said containers, said mating area of each of said perimeter walls comprising:

a mating surface having an opening extending therethrough for granting access to said interior, said opening being defined by a perimeter edge, said perimeter edge having a top edge, a bottom edge and a pair of lateral side edges; and wherein said containers are couplable together so that said opening of one container is aligned with said opening in said another one of said containers such that said interiors of said containers are in fluid communication with each other to commingle the cremated remains.

2. The assembly according to claim 1, wherein each of said containers further includes a sealing plug being removably received by said filling aperture for sealing said filling aperture.

3. The assembly according to claim 1, wherein each of said mating surfaces further includes:

said opening having a first width defined as a distance between said lateral side edges and a first height defined as a distance between said top edge and said bottom edge;

a continuous adhesive strip being positioned on said mating surface and surrounding said perimeter edge, said adhesive strip having an interior edge adjacent said perimeter edge and an exterior edge, said adhesive strip having a second width defined as a distance between said interior edge and said exterior edge.

4. The assembly according to claim 3, wherein each of said mating surfaces further includes:

a barrier being removably attached to said mating surface for sealing said opening, said barrier being attached to said mating surface by said adhesive strip, said barrier comprising a flexible wall having a top end, a bottom end and a pair of lateral side ends, said barrier having a tab attached thereto and configured to aid in removal of said barrier from said mating surface, said barrier having a third width defined as a distance between said lateral side ends and a second height defined as a distance between said top end and said bottom end, wherein said third width exceeds said first width and said second height exceeds said first height; and wherein said containers are placed in a condition of being in fluid communication with each other when said barrier is removed from each of said containers.

5. A memorial urn assembly configured for storing cremated remains, said assembly comprising:

a pair of containers, each of said container including;

a perimeter wall defining an interior, said perimeter wall having an interior surface and an exterior surface, said perimeter wall having a filling aperture therein for filling said interior with the cremated remains, said filling aperture having a continuous outer edge and extending through said exterior surface and said interior surface, a sealing plug being removably received by said filling aperture for sealing said filling aperture;

said perimeter wall of one of said containers having a mating area configured to engage with a mating area of another one of said containers, said mating area of each of said perimeter walls comprising:

a mating surface having an opening extending therethrough for granting access to said interior, said opening being defined by a perimeter edge, said perimeter edge having a top edge, a bottom edge and a pair of lateral side edges, said opening having a first width defined as a distance between said lateral side edges and a first height defined as a distance between said top edge and said bottom edge;

a continuous adhesive strip being positioned on said mating surface and surrounding said perimeter edge, said adhesive strip having an interior edge adjacent said perimeter edge and an exterior edge, said adhesive strip having a second width defined as a distance between said interior edge and said exterior edge;

a barrier being removably attached to said mating surface for sealing said opening, said barrier being attached to said mating surface by said adhesive strip, said barrier comprising a flexible wall having a top end, a bottom end and a pair of lateral side ends, said barrier having a tab attached thereto and configured to aid in removal of said barrier from said mating surface, said barrier having a third width defined as a distance between said lateral side ends and a second height defined as a distance between said top end and said bottom end, wherein said third width exceeds said first width and said second height exceeds said first height; and wherein said containers are couplable together so that said opening of one container is aligned with said opening in said another one of said containers such that said interiors of said containers are in fluid communication with each other to commingle the cremated remains when said barriers are removed.

6. A memorial urn assembly configured for storing cremated remains, said assembly comprising:

a pair of containers, each of said container including;

a perimeter wall defining an interior, said perimeter wall having an interior surface and an exterior surface, said perimeter wall having a filling aperture therein for filling said interior with the cremated remains, said filling aperture having a continuous outer edge and extending through said exterior surface and said interior surface;

said perimeter wall of one of said containers having a mating area configured to engage with a mating area of another one of said containers, said mating area of each of said perimeter walls comprising:

a mating surface having an opening extending therethrough for granting access to said interior, said opening being defined by a perimeter edge, said perimeter edge having a top edge, a bottom edge and a pair of lateral side edges, said opening having a first width defined as a distance between said lateral side edges and a first height defined as a distance between said top edge and said bottom edge;

a barrier being removably attached to said mating surface for sealing said opening, said barrier being attached to said mating surface by an adhesive strip, said barrier comprising a flexible wall having a top end, a bottom end and a pair of lateral side ends; and wherein said containers are couplable together so that said opening of one container is aligned with said opening in said another one of said containers such that said interiors of said containers are in fluid communication with each other to commingle the cremated remains when said barriers are removed.

* * * * *